US011557447B2

(12) United States Patent
Shimazu et al.

(10) Patent No.: US 11,557,447 B2
(45) Date of Patent: Jan. 17, 2023

(54) SWITCH DEVICE

(71) Applicants: HONDA MOTOR CO., LTD., Tokyo (JP); TOYO DENSO CO., LTD., Tokyo (JP)

(72) Inventors: Yoshinobu Shimazu, Wako (JP); Yuki Kuno, Wako (JP); Taiji Okawa, Wako (JP); Kouji Yamazaki, Tsurugashima (JP); Hiroyuki Abe, Tsurugashima (JP); Mitsuhiro Kondo, Tsurugashima (JP)

(73) Assignees: Honda Motor Co., Ltd., Tokyo (JP); Toyo Denso Co., Ltd., Tokyo (JP)

( * ) Notice: Subject to any disclaimer, the term of this patent is extended or adjusted under 35 U.S.C. 154(b) by 0 days.

(21) Appl. No.: 17/173,520

(22) Filed: Feb. 11, 2021

(65) Prior Publication Data

US 2021/0296068 A1 Sep. 23, 2021

(30) Foreign Application Priority Data

Mar. 18, 2020 (JP) ..... JP2020-047751

(51) Int. Cl.
*H01H 23/06* (2006.01)
*H01H 23/16* (2006.01)
*H01H 23/04* (2006.01)

(52) U.S. Cl.
CPC ..... *H01H 23/16* (2013.01); *H01H 23/04* (2013.01)

(58) Field of Classification Search
CPC .. H01H 2300/03; H01H 23/04; H01H 23/145; H01H 23/16; H01H 23/14; H01H 23/24; H01H 23/12; H01H 23/025; H01H 23/143; H01H 23/205; H01H 23/30; H01H 23/02; H01H 23/28; H01H 23/08; H01H 23/146; H01H 23/162; H01H 23/164; H01H 23/20; H01H 13/06; H01H 2223/002; H01H 9/04; H01H 13/86; H01H 21/08; H01H 2223/044; H01H 23/06; H01H 19/06
See application file for complete search history.

(56) References Cited

U.S. PATENT DOCUMENTS 6,191,372 B1 2/2001 Sasaki et al.
2014/0231233 A1* 8/2014 Mori ..... H01H 23/06 200/302.3

FOREIGN PATENT DOCUMENTS

JP 2000-348569 A 12/2000
JP 2015-050048 A 3/2015

* cited by examiner

*Primary Examiner* — Ahmed M Saeed
(74) *Attorney, Agent, or Firm* — Carrier Shende & Associates, P.C.; Joseph P. Carrier; Fulchand P. Shende

(57) ABSTRACT

A switch device includes a panel housing a knob, the panel having a wall face around the knob. In at least one of outside faces of the knob, the outside faces opposing the wall face and another member adjacent to the knob, the outside face has a base part formed on an upper side thereof and a recess part formed in a lower side thereof. The recess part extends to a lower end of the outside face. The base part has an obliquely downwardly inclined parts formed on a lower edge part thereof. Accordingly, the device can ensure stable operation of the knob by discharging, from a gap between the panel and the knob, liquid that has entered the gap.

4 Claims, 8 Drawing Sheets

SWITCH DEVICE

BACKGROUND OF THE INVENTION

Field of the Invention

The present invention relates to a switch device in which a switch part is turned ON/OFF by the operation of a knob housed in a panel so that a movable terminal and a fixed terminal are in contact or are separated.

Description of the Related Art

For example, a power window device of a vehicle is provided with a rocker switch; when one end of a knob of the rocker switch is pushed down so as to make it rock downward, a door window is lowered by electrical power, and when one end of the knob is pulled up so as to make it rock upward, the door window is raised by electrical power.

In such a rocker switch, a panel 101 and a knob 111 shown in sectional view in FIG. 8 are formed by injection molding a resin, and in order to enable them to be released from a mold (a fixed mold and a movable mold) at the time of injection molding, an inner peripheral face 101*a* of a recess part 101A, housing the knob 111, of the panel 101 and an outside face 111*a* of the knob 111 opposing the inner peripheral face 101*a* have draft angles formed thereon that are in opposite directions from each other. Specifically, formed on the inner peripheral face 101*a* of the recess part 101A of the panel 101 is a draft angle in an orientation so that an opening area of the recess part 101A narrows in going downward, and formed on the outside face 111*a* of the knob 111 is a draft angle in an orientation so that the width of the knob 111 increases in going downward.

A gap Δ having a width that narrows in going downward is therefore formed between the inner peripheral face 101*a* of the recess part 101A of the panel 101 and the outside face 111*a* of the knob 111.

However, as shown in FIG. 8, when the gap Δ, which narrows in going downward, is formed between the inner peripheral face 101*a* of the recess part 101A of the panel 101 and the outside face 111*a* of the knob 111, for example, when a liquid such as a drink having a high sugar content is spilled and enters the gap Δ between the panel 101 and the knob 111, the liquid thus entering cannot pass through the gap Δ and builds up therein; when the liquid that has built up in the gap Δ dries, the sugar content therein solidifies and the knob 111 sticks to the panel 101, and it takes a long time for the knob 111 to return, there thus being room for improvement in terms of ease of operation.

Japanese Patent Application Laid-open No. 2000-348569 proposes an arrangement in which an outside face of a knob is inclined along an inner peripheral face of a recess part of a panel in the same direction, and a recess part is formed in the outside face. Japanese Patent Application Laid-open No. 2015-050048 proposes an arrangement in which a liquid flow guide path extending downward is provided in an outside face, opposing an inner peripheral face of a panel, of a knob.

However, in the arrangement proposed in Japanese Patent Application Laid-open No. 2000-348569, since the gap between an edge part, at the peripheral edge of the recess part, of the outside face of the knob and the inner peripheral face of the recess part of the panel is narrow, there is the problem that liquid easily builds up in the gap. In the arrangement proposed in Japanese Patent Application Laid-open No. 2015-050048 there is the problem that liquid easily builds up in an end part of the liquid flow guide part.

SUMMARY OF THE INVENTION

The present invention has been accomplished in light of the above problems, and it is an object thereof to provide a switch device that can ensure stable operation of a knob by discharging, from a gap between a panel and the knob, liquid that has entered the gap.

In order to achieve the object, according to an aspect of the present invention, there is provided a switch device comprising a panel housing a knob, the panel having a wall face around the knob, in at least one of outside faces of the knob, the outside faces opposing the wall face and another member adjacent to the knob, the outside face having a base part formed on an upper side thereof and a recess part formed in a lower side thereof, the recess part extending to a lower end of the outside face, and the base part having an obliquely downwardly inclined part formed on a lower edge part thereof.

In accordance with the aspect of the present invention, even when a liquid such as for example a drink having a high sugar content is spilled and enters the gap, the liquid thus entering flows along the inclined part formed in the lower edge part of the base part of the outside face of the knob and is discharged via the lower end of the knob. As a result, the conventional problem that the sugar content in a liquid that has built up in the gap solidifies and the knob sticks to the panel will not occur, stable operation of the knob is ensured, and the ease of operation of the switch device is improved.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

Figure 1:
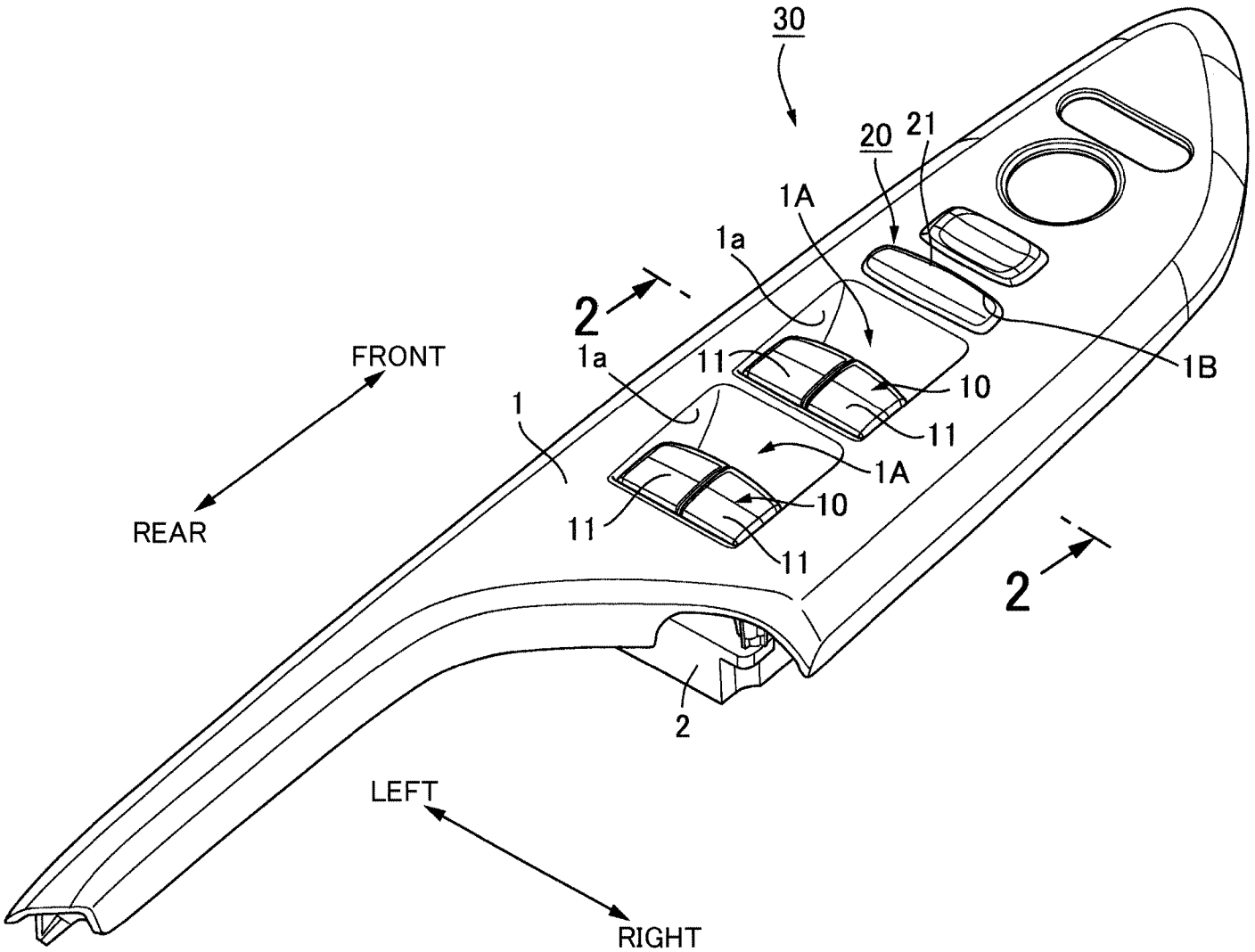
FIG. 1 is a perspective view of a vehicular switch operating part equipped with a switch device related to an embodiment of the present invention.
Figure 2:
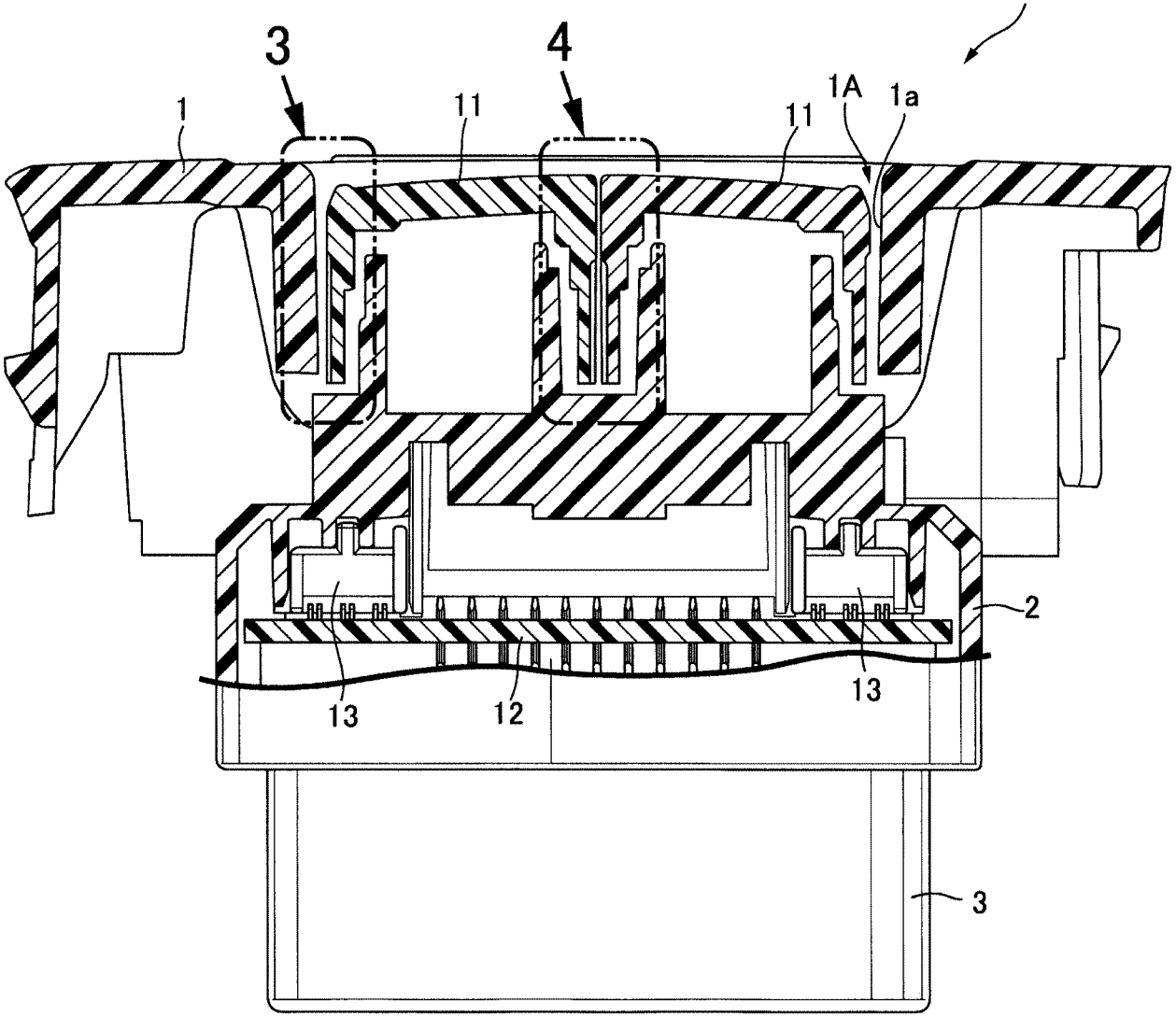
FIG. 2 is a cutaway sectional view along line 2-2 in FIG. 1.
Figure 3:
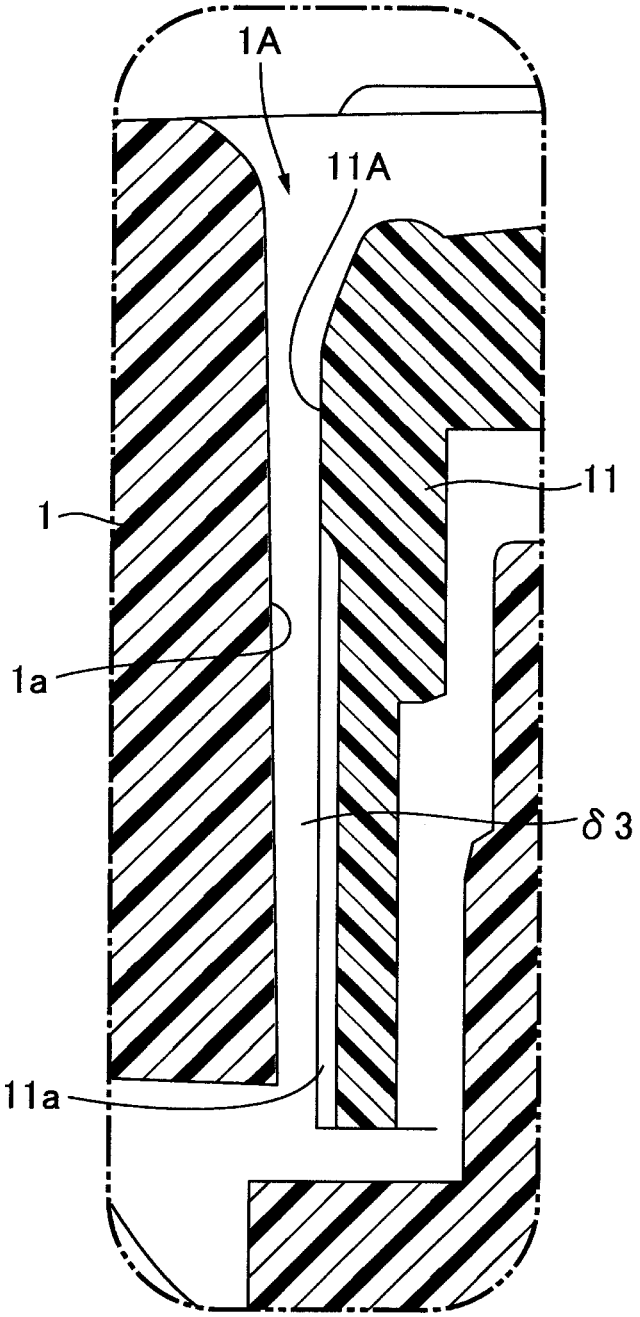
FIG. 3 is an enlarged detailed view of part 3 in FIG. 2.
Figure 4:
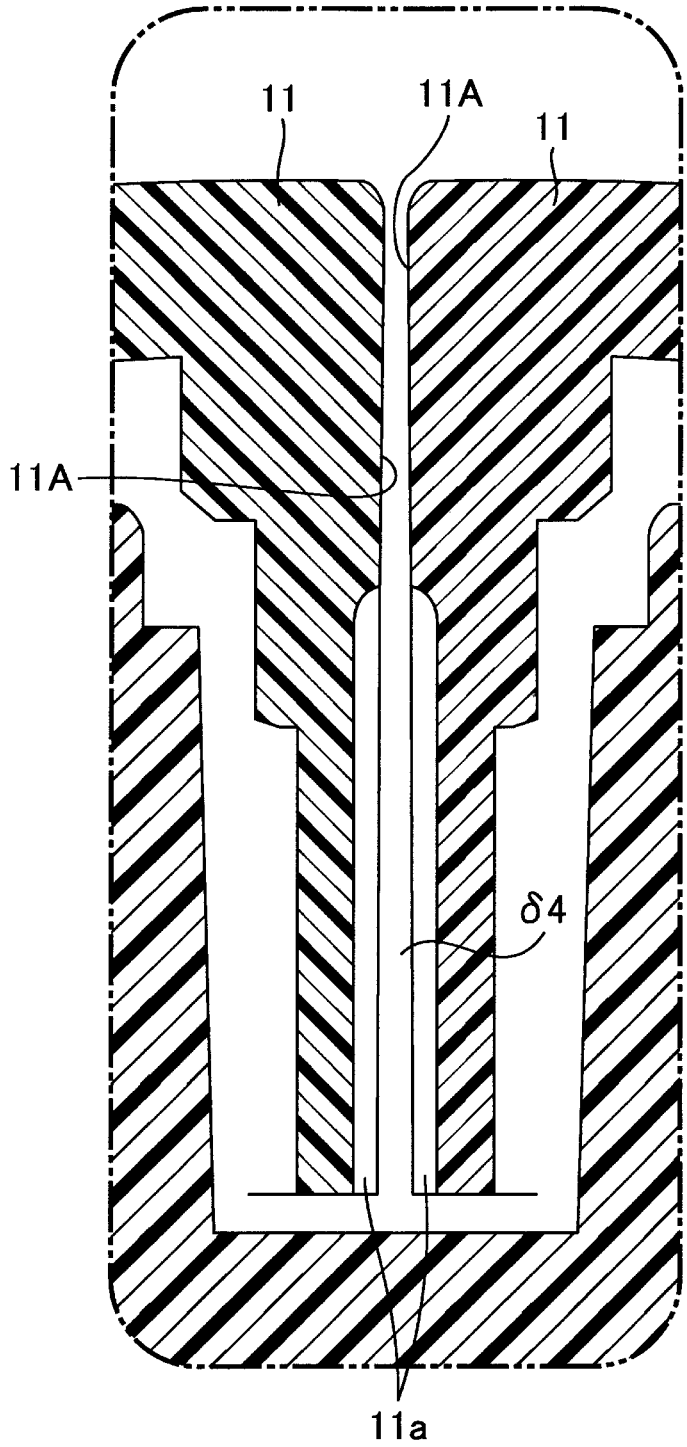
FIG. 4 is an enlarged detailed view of part 4 in FIG. 2.
Figure 5:
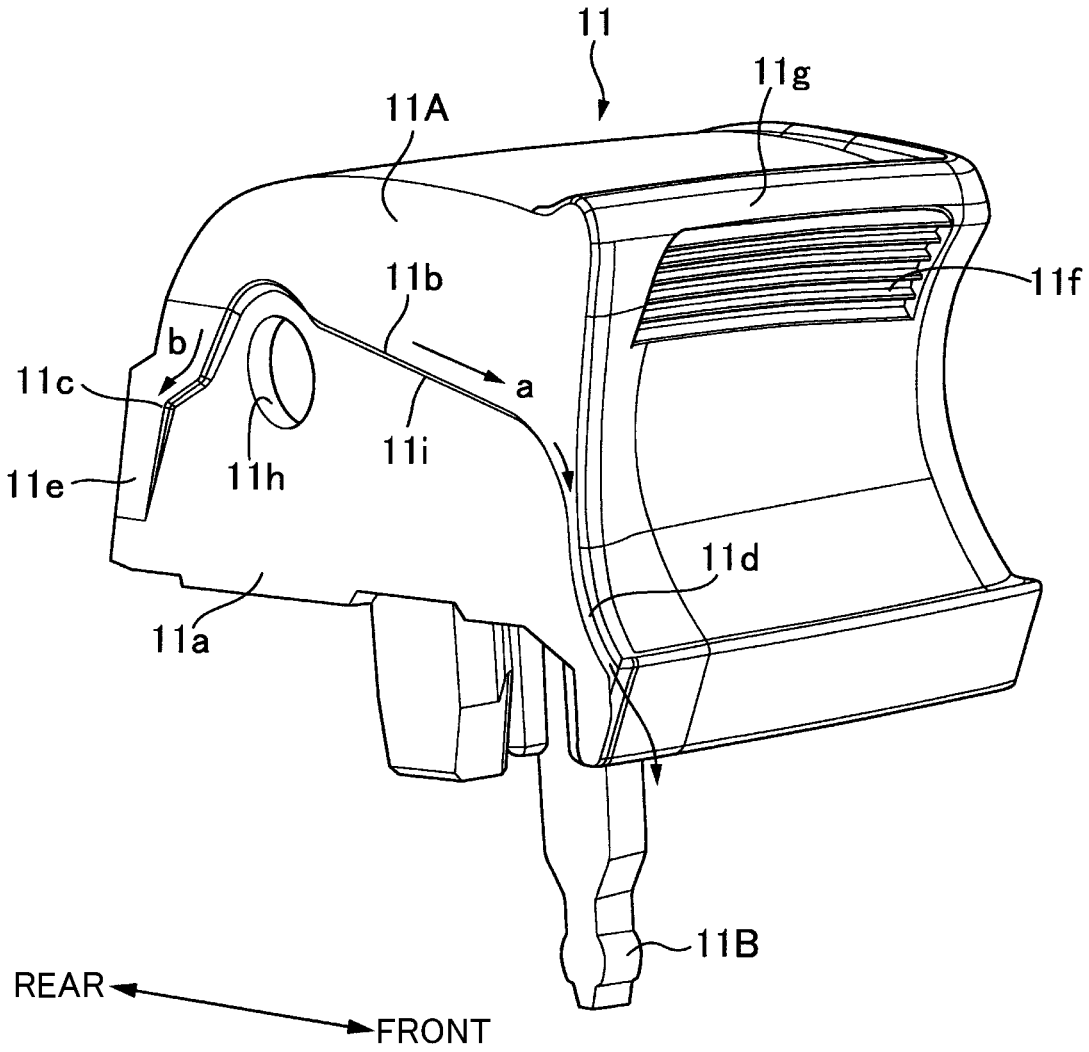
FIG. 5 is a perspective view of a knob of the switch device related to the present embodiment.
Figure 6:
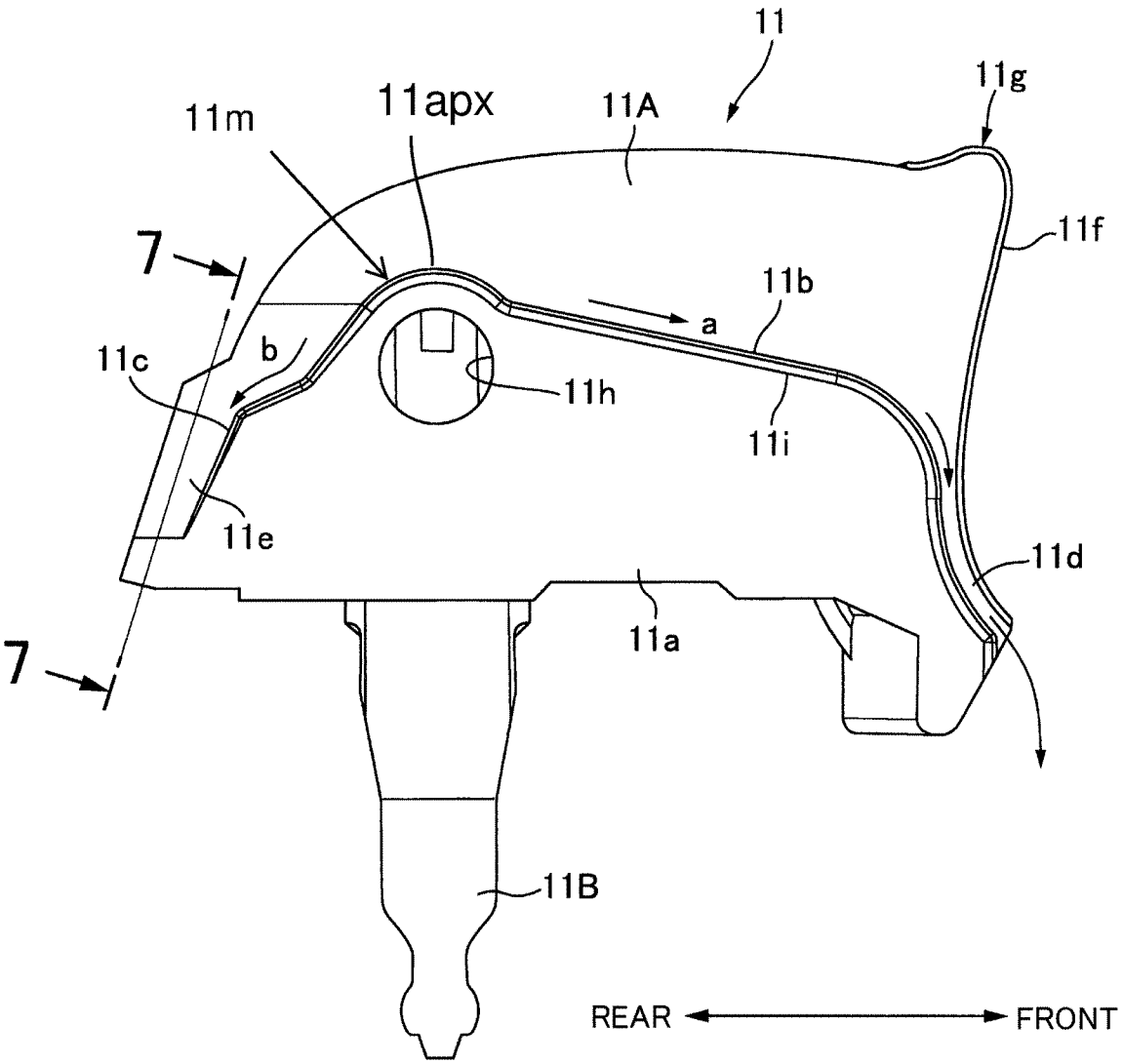
FIG. 6 is a side view of the knob of the switch device related to the present embodiment.
Figure 7:
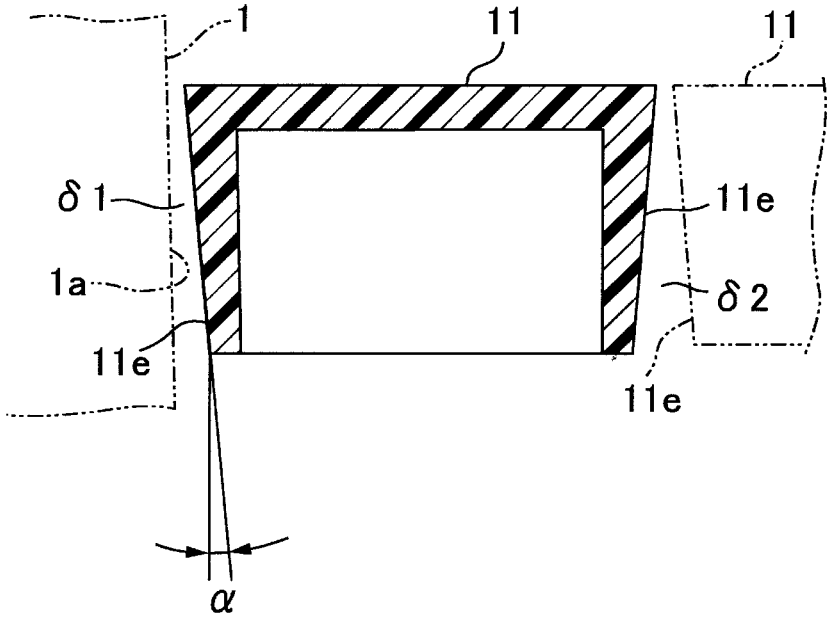
FIG. 7 is a sectional view along line 7-7 in FIG. 6.
Figure 8:
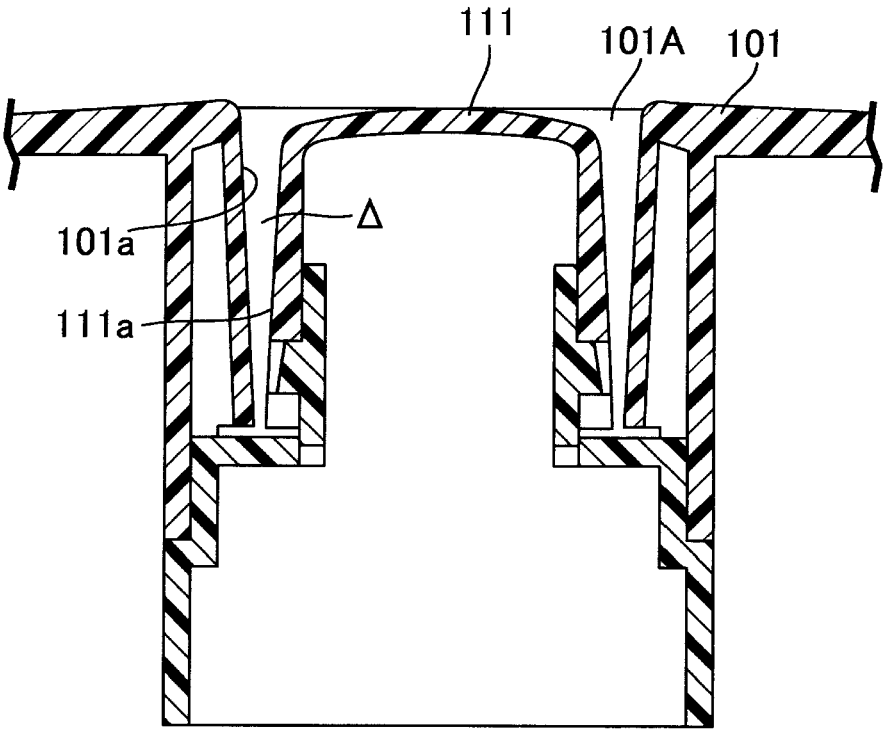
FIG. 8 is a sectional view of a knob and a panel of a conventional switch device.

FIG. 1 is a perspective view of a vehicular switch operating part equipped with a switch device related to the present embodiment, FIG. 2 is a cutaway sectional view along line 2-2 in FIG. 1, FIG. 3 is an enlarged detailed view of part 3 in FIG. 2, FIG. 4 is an enlarged detailed view of part 4 in FIG. 2, FIG. 5 is a perspective view of a knob, FIG. 6 is a side view of the knob, and FIG. 7 is a sectional view along line 7-7 in FIG. 6.

A switch operating part 30 shown in FIG. 1 is for operating a power window device, which is not illustrated, that raises and lowers a door window of a vehicle by electrical power, and it is disposed on an inner face of a vehicular door (one disposed on a left door being illustrated as one example).

The switch operating part 30 shown in FIG. 1 is equipped with a narrow panel 1 that is long in the vehicle fore-and-aft direction, and a case 2 housing various types of components is mounted beneath the panel 1. Two recessed parts 1A having a substantially rectangular shape in plan view are formed side-by-side in the fore-and-aft direction to the rear of the panel 1 in the vehicle, and a rocker switch 10 is housed in each of the recessed parts 1A. Here, each rocker switch 10 includes two knobs 11 on the left and right that can be operated so as to rock independently from each other. Each rocker switch 10 is for raising and lowering the door window by an end part of each knob 11 being pulled up or pushed down, and serves as the switch device.

Formed in front of the recessed part 1A housing the rocker switch 10 of the panel 1 is a narrow recessed part 1B having a substantially rectangular shape that is long in the lateral direction (left-and-right direction), and housed in the recessed part 1B is a narrow push switch 20 having a substantially rectangular shape that is similarly long in the lateral direction in plan view so that it can be operated by being pushed down. In the present embodiment, the panel 1 and the case 2 are formed by injection molding a resin. The push switch 20 is a lock switch for locking the raising and lowering of the door window.

The rocker switch 10 serving as the switch device is now explained. Since the two rocker switches 10 at the front and rear have the same arrangement, only one rocker switch 10 is explained below.

As shown in FIG. 2, the rocker switch 10 includes two knobs 11 arranged laterally side-by-side as operating parts facing the recessed part 1A of the panel 1, and these knobs 11 are rockably supported on the case 2. A substrate 12 is placed horizontally beneath the knobs 11 within the case 2, and two switch parts 13 on the left and right are mounted on the substrate 12 so as to correspond to the left and right knobs 11. A cover 3 is attached to a lower part of the case 2.

The cover 3 and the knob 11 are formed separately by injection molding a resin, and each knob 11 is formed into a rectangular box shape opening downward. As shown in FIG. 5 and FIG. 6, a front end face of the knob 11 is formed into a concavely-curved face shape, and a gap is formed between the front end face and the recessed part 1A of the panel 1 as shown in FIG. 1, the gap allowing an occupant operating the knob 11 to insert a finger thereinto. Formed on an upper part of the front end face of the knob 11 is an operation portion 11*f* via which the knob 11 is pulled up, and formed on a front end part of an upper face of the knob 11 is an convexly-shaped operation portion 11*g* via which the knob 11 is pushed down.

As shown in FIG. 5 and FIG. 6, formed in left and right outside faces forming substantially vertical planes of the knob 11 is a circular hole-shaped shaft hole 11*h* (only one thereof being illustrated in FIG. 5 and FIG. 6), and fitted into the shaft hole 11*h* is a columnar shaft, which is not illustrated, projectingly provided on the case 2 side. Because of this, the knob 11 is pivotally supported on the case 2 so that it can rock in the up-down direction with the shaft as a center.

An angular rod-shaped operation element 11B is provided integrally with the knob 11 so as to extend vertically downward; operating the operating portions 11*f*, 11*g* formed on the front end part of the knob 11 so as to make the knob 11 rock with the shaft, which is not illustrated, as a center makes the operation element 11B rock accordingly, rocking of the operation element 11B makes a movable terminal and a fixed terminal, which are not illustrated, be in contact with or separated from each other, thereby allowing the two to be electrically connected or disconnected, as a result the switch part 13 shown in FIG. 2 is turned ON/OFF, and the door window is raised or lowered according to the direction in which the knob 11 is rocked. Specifically, pushing down the operating portion 11*g* provided on the front end part of the knob 11 makes the knob 11 rock downward and the door window is lowered, whereas pulling up the operating portion 11*f* makes the knob 11 rock upward and the door window is raised.

As shown in FIG. 5 and FIG. 6, an upper base part 11A and a lower recess portion 11*a* are formed on both the left and right outside faces of the knob, and a margin 11*m* between these parts extends along the side of the outside face above the recess portion. The uppermost portion of the margin 11*m*, above the shaft hole 11*h*, forms an apex part 11*apx* thereof. The recess portion 11*a* extends from a lower face of the upper base part 11A to the lower end of the outside face, and has its lower part open. The margin 11*m* includes inclined guide portions 11*b*, 11*c* (also referred to herein as inclined portions) formed on a lower edge portion 11*i* of the upper base part 11A, and these inclined guide portions are inclined obliquely downward from the apex part 11*apx* toward end parts of the knob 11 in the fore-and-aft directions (longitudinal direction), respectively. In more detail, the inclined guide portions 11*b*, 11*c* are formed on the upper base part 11A of the knob 11 so as to be inclined downward toward a front end part and a rear end part respectively, at positions in front of and to the rear of a portion where the shaft hole 11*h* is formed, and with the apex part 11*apx* as a vertex, as shown. Here, one (front) inclined portion 11*b* has a longer length and a smaller inclination than that of the other (rear) inclined portion 11*c*.

Among the two inclined portions 11*b*, 11*c* formed on the base part 11A of each of the left and right outside faces of the knob 11, formed on a front end part of the front inclined portion 11*b* is a discharge portion 11*d* that is inclined obliquely downward and has a width that narrows in going toward the extremity.

As shown in FIG. 7, of the lower edge portion 11*i* of the base part 11A of each of the outside faces of the knob 11, formed on a rear portion where the inclined portion 11*c* is formed is an inclined face 11*e* that is as illustrated inclined only by an angle α obliquely downward toward the inside in the width direction orthogonal to the fore-and-aft direction. Because of this, a gap δ1 having a width that widens in going downward is formed between the inclined face 11*e* and a wall face 1*a*, opposed thereto, on the inner periphery of the recessed part 1A of the panel 1, and a gap δ2 having a width that widens in going downward is formed between the inclined faces 11*e* of the two mutually adjacent knobs 11.

As shown in FIG. 3, a gap 63 is formed between the wall face 1*a* and the outside face of the knob 11, and as shown in FIG. 4 a gap δ4 is formed between the outside face of the knob 11 and an outside face of the other knob 11 adjacent to said knob 11.

In the rocker switch 10 as arranged above, even when a liquid such as for example a drink having a high sugar content has been spilled and entered the gaps δ3, δ4, the liquid thus entering flows as shown by arrows a, b in FIG. 5 and FIG. 6 along the inclined portions 11*b*, 11*c* formed on the lower edge portion 11*i* of the base part 11A on the outside face of the knob 11 and is discharged via the lower end of the knob 11. As a result, the conventional problem that the sugar content in a liquid that has built up in the gaps δ3, δ4 solidifies and causes the knob 11 and the panel 1 or the adjacent knobs 11 to stick to each other will not occur, and stable operation of the knob 11 is ensured, thus improving ease of operation of the rocker switch 10.

In the present embodiment, as shown in FIG. 5 and FIG. 6, since the discharge portion 11*d*, which is inclined obliquely downward and has a width that narrows in going toward the extremity, is formed on the end part of one (front) inclined portion 11*b* provided on the lower edge portion 11*i* of the base part 11A on the outside face of the knob 11, the following effects can be obtained. That is, the flow of a liquid that has entered the gaps 63, 64 between the outside face of the knob 11 and the wall face 1*a* and outside face of another knob 11 adjacent to said knob 11 is concentrated toward the discharge portion 11*d* along the inclined portion 11*b*, the liquid is therefore discharged via the discharge portion 11*d*, and sticking of the knob by means of the liquid is prevented, thereby ensuring high stability in the operation of the knob.

In the present embodiment, the tapered discharge portion 11*d*, which has a width that narrows uniformly toward the extremity, is formed on an end part of the inclined portion 11*b* on the outside part of the knob 11, but as a discharge part one having a width that becomes narrow in a specific portion and is thereafter constant toward the lower end may be used, and in essence one that exhibits a liquid discharge function to a degree that can ensure stable operation of the knob 11 may be used.

Furthermore, in the present embodiment, as shown in FIG. 7, since the inclined face 11*e*, which is inclined obliquely downward in going toward the inside in the width direction, is formed on the rear portion of the base part 11A of the knob 11, the gaps δ1, δ2 having a width that widens in going downward are formed between the inclined face 11*e* and the wall face 1*a* opposite thereto and inclined face 11*e* of the other knob 11. Because of this, the liquid can more easily be discharged via these gaps δ1, δ2, and stable operation of the knob 11 becomes possible.

Moreover, in the present embodiment, since the knob 11 is formed so that the apex part is positioned on the upper parts of the inclined parts, and the inclined parts are inclined from the apex part downward toward end parts of the respective opposite side parts in the longitudinal direction, the appearance of the switch device 10 can be enhanced.

A mode in which the present invention is applied to the rocker switch 10 in which a door window is electrically raised or lowered by the power window device is explained above, but the present invention may be applied not only to any other rocker switch but also to a push switch in the same manner.

Furthermore, in the embodiment explained above the rocker switch 10 includes two knobs 11 in which the inclined portions 1*b*, 1*c* are formed on the lower edge portion 11*i* of the base part 11A on each of the outside faces (left and right outside faces) of each knob 11 opposing the wall face 1*a* on the inner periphery of the recessed part 1A of the panel 1 and the other knob 11 adjacent to said knob 11, but the present invention may be applied to a rocker switch or a push switch that includes only a single knob, in the same manner. In this case, an inclined part is formed on the lower edge portion 11*i* of the base part 11A on the outside face, opposing the wall face 1*a* on the inner periphery of the recessed part of the panel, of the knob.

An embodiment of the present invention is explained above, but the present invention is not limited to the above-mentioned embodiment and may be modified in a variety of ways as long as the modifications do not depart from the gist of the present invention.

What is claimed is:

1. A switch device comprising a panel housing a first knob which is configured to be rockably operated, the panel having a wall face around the first knob, the first knob having outside faces opposing the wall face, and the switch device including a second knob adjacent to the first knob, the first knob having a shaft hole formed in at least one of the outside faces thereof, the one outside face, which contains the shaft hole, having a base part formed on an upper side thereof and a recess part formed in a lower side thereof, the recess part extending to a lower end of the one outside face, and the base part having an obliquely downwardly inclined part formed on a lower edge part thereof, wherein a discharge part, where the base part has a narrow width, is formed on an end part of the base part along the inclined part, and wherein an inclined face is formed on an end part in a longitudinal direction, on a side of the base part of the first knob opposite to the discharge part, the inclined face being inclined obliquely downward in going inward in a width direction that is orthogonal to the longitudinal direction.

2. The switch device according to claim 1, further comprising a switch part operable to be turned ON/OFF when the first knob is rockably operated with an axis thereof as a center, wherein the first knob is formed to have an apex part which is positioned above the shaft hole in a vertical direction, and the inclined part includes a front portion and a rear portion which is formed to extend rearwardly from the apex part and inclined from the apex part downward and toward an end part of the first knob in an opposite side part from the discharge part in the longitudinal direction.

3. The switch device according to claim 1, wherein the inclined part is formed on lower edge parts of the base parts of the outside faces of each of the first knob and the second knob, respectively.

4. The switch device according to claim 2, wherein the inclined part is formed on lower edge parts of the base parts of the outside faces of each of the first knob and the second knob, respectively.

* * * * *